United States Patent [19]

Kirby

[11] Patent Number: 4,813,881

[45] Date of Patent: Mar. 21, 1989

[54] VARIABLE INSERTION FORCE CONTACT

[75] Inventor: Edward Kirby, Mt. Prospect, Ill.

[73] Assignee: Labinal Components and Systems, Inc., Elk Grove Village, Ill.

[21] Appl. No.: 946,725

[22] Filed: Dec. 29, 1986

[51] Int. Cl.[4] ..... H01R 25/00

[52] U.S. Cl. ..... 439/74; 439/381; 439/654; 439/723; 439/733; 439/631

[58] Field of Search ..... 339/17 M, 17 LM, 17 LC, 339/17 C, 17 R, 159 R, 159 C, 191 M, 192 R, 205, 248 S, 198 P, 198 S; 439/74, 381, 654, 708, 721, 722, 723, 733, 631

[56] References Cited

U.S. PATENT DOCUMENTS

| | | | |
|---|---|---|---|
| 2,301,447 | 11/1942 | Parker et al. | 439/723 |
| 2,380,955 | 8/1945 | Eby | 439/379 |
| 2,392,438 | 1/1946 | Wade | 439/723 |
| 2,603,681 | 7/1952 | Salisbury | 339/205 |
| 2,703,395 | 3/1955 | Long | 439/723 |
| 2,838,739 | 6/1958 | Winkler | 339/47 |
| 2,853,689 | 9/1958 | Jackson et al. | 439/636 |
| 2,904,771 | 9/1959 | Burtt et al. | 339/17 M |
| 2,929,044 | 3/1960 | Herrmann et al. | 339/205 |
| 3,034,093 | 5/1962 | Blain | 339/176 |
| 3,346,834 | 10/1967 | Kinkaid | 339/198 P |
| 3,539,965 | 11/1970 | Morehart et al. | 339/17 M |
| 3,853,389 | 12/1974 | Occhipinti | 339/217 S |
| 4,150,863 | 4/1979 | Krafthefer et al. | 339/17 LC |
| 4,221,451 | 9/1980 | Petreliwicz et al. | 339/105 |
| 4,423,917 | 1/1984 | Scheingold et al. | 339/64 |
| 4,445,747 | 5/1984 | Neidich | 339/256 |
| 4,514,784 | 4/1985 | Williams et al. | 439/59 |

FOREIGN PATENT DOCUMENTS

| | | | |
|---|---|---|---|
| 3005634 | 8/1981 | Fed. Rep. of Germany | 339/17 M |
| 1028208 | 5/1966 | United Kingdom | 339/205 |

*Primary Examiner*—Neil Abrams

*Attorney, Agent, or Firm*—Neuman, Williams, Anderson & Olson

[57] ABSTRACT

A female electrical contact is provided having spaced jaws adapted to receive a mating contact such as a male pin. The spaced jaws are formed so that release forces of different magnitude are necessary to withdraw such male contact from the spaced jaws at the opposed contact ends.

13 Claims, 4 Drawing Sheets

FIG. 1
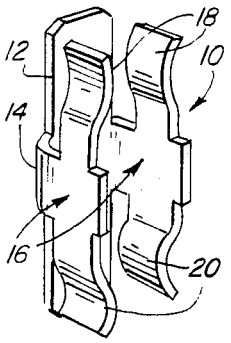
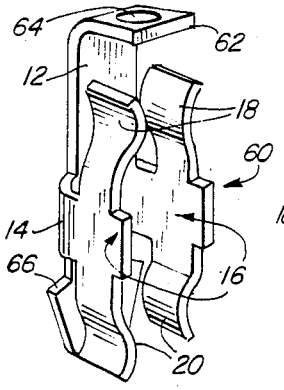
FIG. 2
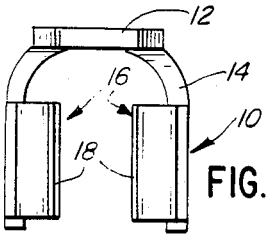
FIG. 3A
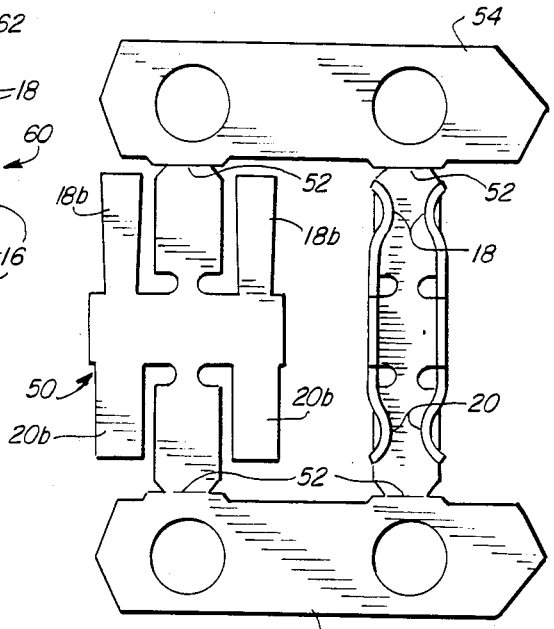
FIG. 3
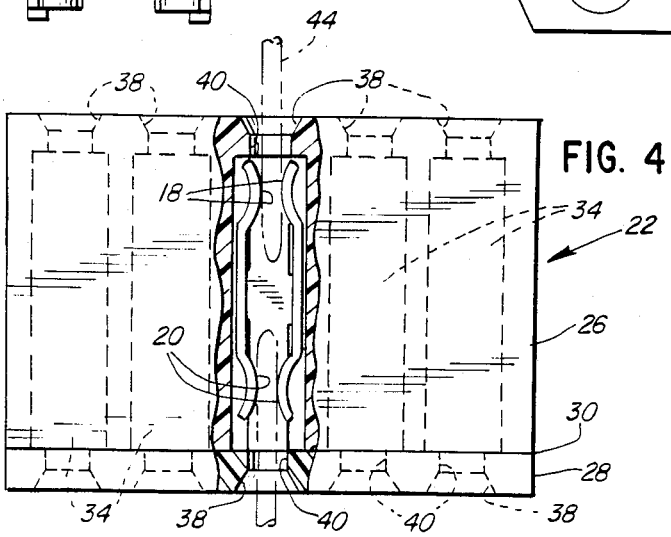
FIG. 4
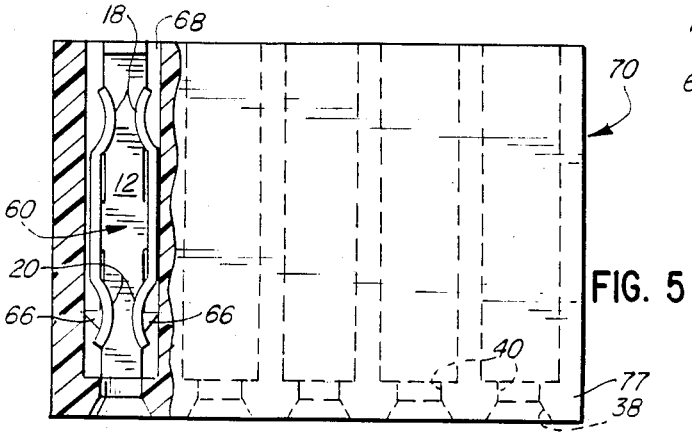
FIG. 5
FIG. 6A
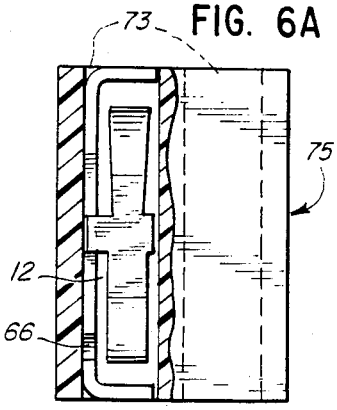
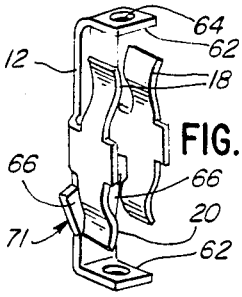
FIG. 6

VARIABLE INSERTION FORCE CONTACT

BACKGROUND OF THE INVENTION

This invention pertains to a female electrical contact having opposed pin-receiving openings. The opposed openings engage male contacts such as pin members received therein so as to require forces of different magnitude to engage and disengage the pins relative to the opposed contact ends.

Accordingly, the provided contacts find particular applicability for use in connectors adapted to effect a connection between pins affixed to two or more PC boards or plugs. By virtue of the differential in pin-engaging forces effected by opposed portions of the provided contacts, one of two interconnected PC boards may be readily released from an intervening electrical connector without disturbing the other board-connector engagement. By exerting a separation force on PC boards joined by the provided contacts, the pins of one PC board will be first released from the connector by virtue of the lesser gripping forces exerted on the contacts of such first-released board by the connector contacts having less pin-gripping action.

The provided contact construction is simple in basic design and readily adaptable to incorporation in a variety of structural modifications. Such modifications enable the contacts to be mounted in an insulator in a variety of fixed relationships providing a variety of connector constructions. Contacts of this invention may be readily connected to a ground plane if desired, and provide for a variety of pin-engaging modes in the course of effecting electrical connections such connections may be effected with male contacts of a PC board, or of male plug multi-pin connectors, or of any device having male contact portions for reception in the opposed female portions of the provided contacts.

DESCRIPTION OF THE PRIOR ART

Blain, U.S. Pat. No. 3,034,093, is directed to an electrical connector socket particularly adapted for use with PC boards, and includes a female contact having opposed female sections. However, there is no suggestion of pin-engaging forces of different magnitude effected by the opposed female portions, and there is no suggestion of any other main structural feature of the provided contact and connector of this invention.

Salisbury, U.S. Pat. No. 2,603,681, is of interest in that it is directed to a printed circuit panel having connector sleeves with opposed female portions. The sleeves engage electron tube prongs and a printed circuit at the opposed ends.

Winkler, U.S. Pat. No. 2,838,739, is directed to an electrical connector adapted to receive opposed male terminals which are adapted to mutually engage in an overlapping interlock. There is no suggestion of the contact-pin engagement present in the contact and connector construction of the provided invention.

Herrmann, et al, U.S. Pat. No. 2,929,044, is directed to a trolley duct connecting means which provides a pair of opposed female connectors. This reference is of interest in that it discloses conducting members 22 and 21 of different widths. However, there is no structural feature of any significance which renders any major feature of the provided contact and connector of applicant's construction obvious.

Scheingold, et al., U.S. Pat. No. 4,423,917, is directed to an electrical connector having movable contact portions. The movable contact elements define opposed female portions whereby misaligned male tab terminals may be engaged. There is no suggestion of any main structural feature of applicant's invention in this reference.

Wade, U.S. Pat. No. 2,392,438, is directed to an electrical connector having opposing female sections for receiving male contacts, and is of interest in that it discloses a means for locating the contact within a receiving insulator housing.

Parker, et al., U.S. Pat. Nos. 2,301,447, Eby, 2,380,955, Long, 2,703,395, Jackson, et al., 2,853,689 and Petrelewicz et al., 4,221,451, and Neidich, 4,445,747, are of interest in that they are directed to contacts and connectors having opposed female portions adapted to receive male pins, plugs or the like, and/or connectors employed in an environment adapted for use with printed circuit boards.

In summary, therefore, it is seen that the prior art does not disclose any of the main structural features provided in the contact and connector of this invention. Such features enable a female connector to engage and release opposed pins of engaged PC boards or the like with different forces, whereby one PC board is engaged and disengaged from a connector more easily and with less force application than the other.

It is an object of the invention, therefore, to provide a female contact having opposed sets of jaws which may be defined by pin-engaging blades of different width. As a result the insertion and release forces imparted to male pins entering one set of jaws are different from the forces necessary to effect pin engagement and release relative to the pins entering the opposed jaws.

It is an object of this invention to provide a variable release force contact embodiment having a locking tongue integrally formed therewith for securely mounting such contact in a one-piece insulator housing. In an alternate construction the contact may be securely encased within a multi-piece insulator housing which can be readily assembled by sonic welding or the like.

It is a further object of this invention to provide novel female contacts mounted in an insulator connector body having restricted entries whereby reception is insured only of male pins having a predetermined maximum size. As a result, damage to the provided contacts is avoided. In a modified assembly, restricted entries may be integrally formed with the female contacts as will be described hereinafter in greater detail.

It is another object of this invention to provide a novel female contact which enables spaced parallel male contacts to pass each other in the course of being received therein for effecting an electrical communication and desired wiping action on the male contacts.

It is yet another object of this invention to provide a novel contact having one female end and a projecting male tail. The tail enables such contact to be mounted directly in a PC board opening or to pass through such a PC board and mate with another connector disposed on the opposite side of such PC board.

It is still another object of this invention to provide a female contact having grounding lugs integrally formed therewith whereby such contact may be directly attached to a grounding plane at one or opposed mating ends.

It is a further object of this invention to provide novel connector constructions incorporating the various contacts of this invention in a variety of insulator housings.

Further advantages of the provided contact and connector constructions and further objects of this invention will be made apparent from the detailed description of the provided invention to follow herein.

In one embodiment of the provided contact of this invention a pair of opposed, substantially parallel, longitudinally extending contact members which may be in the form of strips or blades extend between opposed entryways in an insulator housing in which such contact is mounted. The contact strips are in opposed face-to-face relationship and define separate longitudinally spaced sets of female contacts shaped to exert a compressive force upon insertion of a male contact member such as a pin or the like through the insulator open entryways. The opposed face-to-face strip portions defining the spaced female contacts are of different widths or otherwise constructed at opposite ends so as to provide different compression forces at the opposed contact ends for effecting different insertion and withdrawal forces on the male pins received therebetween. As a result, a pin is removable from one entryway without disturbing the engagement between the male pin engaging the second set of female contacts in the normal course of separating opposed male pins from such contact. Thus in separating two PC boards or two male connectors from an intervening connector or connectors containing such "variable force" contacts, one board or plug will be readily removed from the contacts of lesser gripping power while the second PC board or plug remains in place when separation forces are applied to the opposed boards or plugs and the pins mounted therein.

For a more complete understanding of this invention, reference will now be made to the drawing, wherein:

FIG. 1 is a perspective view of one embodiment of a contact made in accordance with this invention;

FIG. 2 is a view similar to FIG. 1 of a modified contact made in accordance with the teachings of this invention;

FIG. 3 is a plan view illustrating stages in the continuous formation of contacts made in accordance with the teachings of this invention from a continuous strip of material of fabrication;

FIG. 3A is a top plan view of the contact of FIG. 1;

FIG. 4 is a broken-away view partly in section illustrating the contact of FIG. 2 mounted in a connector insulator with male pins engaging opposed ends;

FIG. 5 is a view similar to FIG. 4 illustrating the modified contact of FIG. 2 mounted in an insulator;

FIG. 6 is a perspective view of a further modified contact construction made in accordance with this invention;

FIG. 6A is a view similar to FIGS. 4 and 5 illustrating the contact illustrated in FIG. 6 mounted in an insulator housing;

DESCRIPTION OF THE INVENTION

Figure 8:
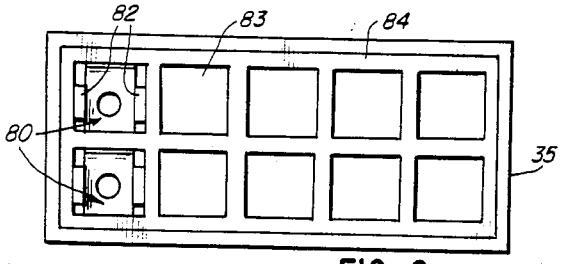
FIG. 8 is a top plan view of the insulator and contact assembly of FIG. 7.

Referring now more particularly to FIG. 1, a contact 10 made in accordance with the teachings of this invention is illustrated comprising a substantially vertically disposed planar spine element 12 integrally formed with arm portions 14 which join the spine 12 to substantially vertically disposed, opposed contact blades or strips 16. The strips 16 have opposed upper and lower contact portions 18 and 20, respectively, which are inwardly bent so as to form restricted gaps defining contact areas or jaws for slidably engaging male pins inserted between such upper and lower contact portions 18 and 20 respectively. It will be noted from FIG. 1 that the contact portions 20 are wider than the contact portions 18 and accordingly, afford greater resistance to the entrance therebetween of a male contact pin than do 4 the narrower contact portions 18. The greater face width of contact portions 20 enables such portions to exert greater compressive force upon engaging a male pin than narrower contact portions 18. Thus, a greater force is necessary to separate a board containing such male pin from portions 20 than would be necessary to remove a male pin of the same diameter from the opposed contact jaw portions 18 of narrower width. In accordance with this invention, the provided contacts by virtue of their structural design allow separation of one PC board from such contacts upon exerting a withdrawal force thereon without disturbing the other connections by virtue of a differential in gripping or holding force on the male pins of two boards engaging such connector. Thus, upon separating two stacked boards engaging contacts such as contacts 10 of FIG. 1, the board-engaging contact portions 18 will be removed with a lesser force than the board-engaging contact portions 20.

The contact 10 of FIG. 1 will normally be disposed in an insulator housing such as housing 22 illustrated in FIG. 4. The housing material may be formed of any known electrically insulating material such as polyethylene terephthalate which may be glass filled for strength purposes. It will be noted from FIG. 4 that the housing 22 comprises an upper integrally molded housing portion 26 disposed over and secured to a bottom 28 by means of ultrasonic welding or any equivalent means for joining the two housing components together at their contacting surfaces. In the normal course of housing assembly with contacts such as contacts 10 of FIG. 1, the contacts are loaded in the open bottomless ends of the upper housing 26 whereafter the bottom 28 is assembled with the upper housing 26 and secured thereto as by ultrasonic welding along interface 30. The height of the contact spine 12 and the interval between outer surfaces of the opposed contact strips 16 is such that the contacts are received within contact openings 34 of the insulator 22 to provide a resulting connector which is substantially rattle-free.

It will be noted from FIG. 4 that both the top and bottom entryway into each contact-receiving chamber 34 have a flared pin-guiding entry portion 38 which communicates with a cylindrical entry portion 40. The entry portions 38 and 40 are adapted to guide a male pin such as illustrated pin 44 illustrated in phantom line into the opening for engagement with the appropriate set of contact jaws 18 or 20. The restricted entry ends to each insulator contact-receiving chamber 34 assure the entrance into the chamber (and into engagement with the contact 10) only of a pin having a maximum size diameter as determined by the entryway cylindrical portion 40. As a result, damage to the contacts 10 occasioned by an oversized pin is prevented.

By way of example, the male pin diameter may be of the order of about 0.020 inch and the gap between the opposed contact portions is of the order of about 0.012 to 0.014 inch at the high-retention force-end adjacent the jaws 20, and the interval between the jaws 18 at the lower-retention end is between 0.013 to 0.15 inch. The intervals may be precisely the same. The provided contact and connector constructions described lend themselves to miniaturization. Thus, by way of example, the contacts of the type illustrated in FIG. 1 may be approximately 0.145 inch in height. An insulator housing such as housing 26 of FIG. 4 may be of the order of 0.17 inch in height and 0.266 inch in length and 0.17 inch in width. Such housing may contain 8 contacts arranged in three parallel rows with the contacts of adjacent rows in staggered relation in housing apertures about 0.04 inch square. The aperture centers of adjacent rows are spaced apart approximately 0.05 inch and the apertures of the same row may be spaced apart on 0.04 to 0.1 inch centers.

FIG. 3 illustrates the manner whereby the contacts 10 of FIG. 1 may be readily stamped from a strip of material of formation such as beryllium copper of approximately 0.004 inch thickness with 115–135 ksi yield strength. FIG. 3 illustrates the strip following a cutting operation whereby a contact blank portion 50 is illustrated at the left in FIG. 3 with opposed ends of such blank 50 connected at score lines 52 to opposed carrier strips 54. The contact jaws 20 are formed from blank portions 20*b* of FIG. 3 and contact jaw portions 18 are formed from blank portions 18*b*. It will be noted from the top plan view of the contact 10 of FIG. 1 illustrated in FIG. 3A, that the connecting arm portions 14 are formed along a radius as they extend from the spine portion 12 for purposes of interconnecting the opposed contact strips 16.

FIG. 3 also illustrates the jaw-forming deformation of the contact blank portions 18*b* and 20*b* following formation of the blank 50 and folding of the opposed contact strip portions 16 along the radius of the interconnecting arms 14 in the manner illustrated in FIG. 3A. the individual contacts 10 are then formed by detaching the spine 12 from the opposed carrier strips 54 at the score lines 52.

Whereas contact 10 of FIG. 1 is meant to be housed within the housing enclosures 34 of housing 22 in the manner illustrated in FIG. 4, contacts 60 of FIG. 2 may be employed in which the contact spine 12 illustrated in FIG. 2 is integrally formed with a restricted entry portion 62 having central pin-receiving opening 64 which forms the same function as does the cylindrical opening portion 40 of the housing 22 illustrated in FIG. 4 of the drawing. Those portions of contact 60 which are common to contact 10 such as opposed contact strips 16 bear the same identifying numerals in the various figures of the drawing Contact 60 of FIG. 2 further distinguishes from contact 10 of FIG. 1 by the integral formation therewith of opposed anchoring tabs 66 which laterally project from opposed edges of spine 12 are adapted to wedge the contact in place in desired location within an insulator opening such as insulator opening 68 in insulator 70 illustrated in FIG. 5 of the drawing. Insulator 70 may be of the same construction as housing 26 of FIG. 4 but in an inverted position. The contact-receiving openings 68 in insulator 70 have an upper open end and the contacts 60 are positioned in desired relationship relative to the open ends by means of the contact-anchoring tabs 66 more clearly seen in FIG. 2. It will be apparent from FIG. 5 that the contact restricted entry tabs 62 having apertures 64 therein and the insulator apertured bottom with aperture portions 38, 40 limit the entry of male pins between the jaws of the opposed contact portions 18 and 20. Integrally formed bottom 77 of insulator 70 with flared openings and restricting necks 40 is identical to the top of housing 26 of insulator 22 illustrated in FIG. 4.

FIG. 6A illustrates a further contact and insulator assembly in which a connector housing 75 is employed which has no top or bottom. Opened-ended contact-receiving openings 73 of housing 75 are employed with illustrated contacts 71 of FIG. 6 which have opposed restricted entry ends 62 integrally formed with contact spine portion 12. Contact 71 also employs the locking tabs 66 of the contact 60 of FIG. 2, enabling each contact 71 to be securely locked in a press fit within an opening 73 of illustrated insulator 75 of FIG. 6A. The insulator housing 75 of FIG. 6A is obviously the least expensive to manufacture as it requires neither a top nor a bottom. The most expensive insulator of the illustrated embodiments comprises that of FIG. 4 requiring a separate insulator bottom 28. Insulator housing 70 of FIG. 5 merely requires housing 26 of FIG. 4 with no bottom as above noted and has an expense intermediate the insulator housings of FIGS. 4 and 6A.

Figure 7:
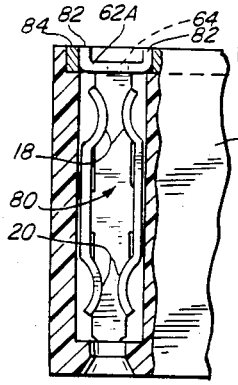
FIG. 7 is a view similar to FIGS. 4, 5 and 6 illustrating a contact having integral grounding lugs mounted in an insulator housing fragmentarily illustrated.
Figure 7A:
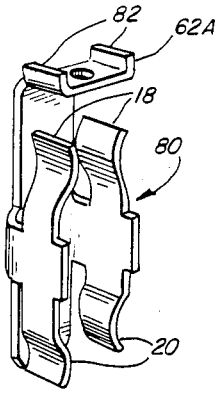
FIG. 7A is a perspective view of a contact similar to that of FIG. 2 having grounding lugs formed therewith.

Contact 80 of FIG. 7A has integrally formed with upper restricted entry end portion 62, opposed upwardly projecting grounding lugs 82 which are press fit or soldered into appropriate receiving openings in a conducting ground plane such as openings 83 of illustrated ground plane 84 embedded or otherwise secured to the upper recessed surface of illustrated insulator housing 35 in the manner illustrated in FIG. 8. FIG. 7 illustrates grounding lugs 82 of contact 80 in an interference friction fit with the inner periphery of a ground plane opening 83. It will be noted from FIG. 7A that the structure of the contact 80 is substantially the same as the structure of the contact 60 of FIG. 2 with the exception of the presence of the grounding lugs 82. Lugs 82 may also be disposed on the opposed contact ends of contact 71 illustrated in FIG. 6.

Figure 9:
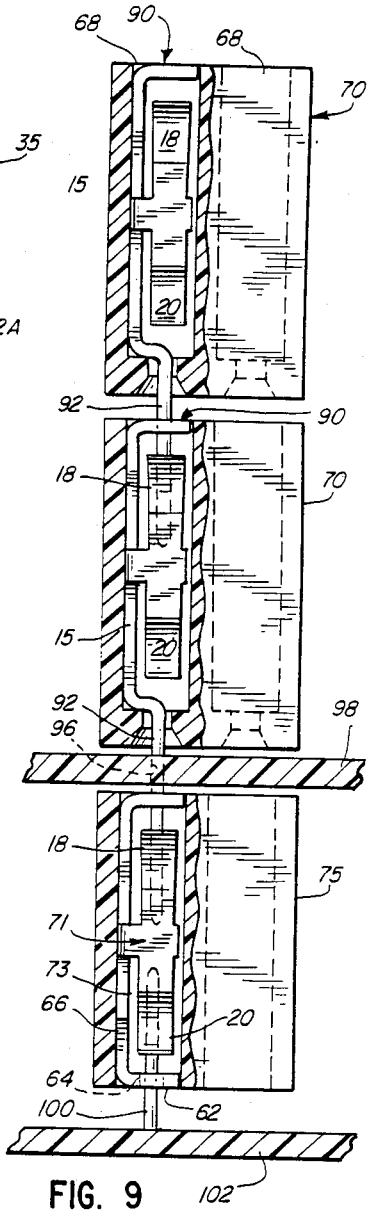
FIG. 9 is a sectional view partly in elevation illustrating stacked PC boards employing connectors having mounted therein contacts made in accordance with the teachings of this invention.

FIG. 9 is a sectional view illustrating the manner whereby upper contacts 90 made in accordance with the teachings of this invention may have a spine portion 15 thereof provided with an elongate tail 92 which extends exteriorly of the insulator housing in which disposed for purposes of engaging another connector or an opening in a PC board.

Thus, it will be seen from FIG. 9 that uppermost contact 90 mounted in opening 68 of insulator 70, may have tail 92 extending from the lower opening of the insulator for purposes of engaging upper jaws 18 of an underlying intermediate contact 90 mounted in an underlying insulator 70. Intermediate contact 90 may have a tail 92 which is press fit or soldered in a plated through opening 96 of PC board 98. The latter tail may also traverse board 98 in a non-electrically conducting engagement.

Tail 92 of intermediate contact 90 illustrated in FIG. 9 and traversing PC board 98 may engage upper jaws 18 of bottom of contact 71 mounted in contact-receiving cavity 73 of insulator 75 of FIG. 9. The lower jaws 20 of contact 71 may engage pin 100 of lower-most PC board 102 after traversing opening 64 in lower restricted entry tab 62. The jaws of contacts engaging pins of stacked PC boards may have release forces which release pins at progressively increasing forces. As a result a stacked arrangement of board and connectors such as is illustrated in FIG. 3 may be readily disconnected in sequence from top to bottom (or other desired order) employing release forces of three or more different magnitudes.

Figure 10:
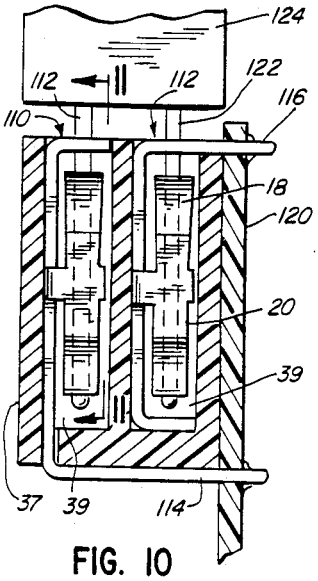
FIG. 10 is a sectional view illustrating further modifications of contacts made in accordance with this invention mounted in an insulator housing, the housing and contacts engaging PC boards disposed at right angles to each other.
Figure 11:
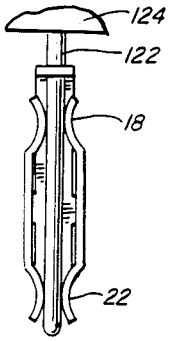
FIG. 11 is a fragmentary elevational view of pin-engaging spaced contact jaws taken along line 11—11 of FIG. 10.

FIG. 10 of the drawing illustrates a contact 110 and contact 112 mounted in adjacent openings 39 of insulator 37. Tails 114 and 116 of the contacts 110 and 112 respectively, exit from opposed ends of the insulator 37 and have right-angle bends therein allowing the terminal tail portions to be soldered or otherwise secured into electrical communication to circuitry disposed on PC board 120. It will be noted that the plane of the surface of male connector 124 from which pins 122 extend, and the plane of PC board 120 are at substantially right angles. A PC board having pins 122 could be substituted for connector 124 in the assembly of FIG. 10. It will be seen from FIGS. 10 and 11 that the length of male pins 122 of connector 124 is such as to traverse not only the upper contact jaw portions 18 but in addition the lower contact jaws 20. Jaws 18–20 of FIG. 11 may have identical release characteristics. As a result, each of the male pins 122 engages at four points of contact with each of the contacts 110 and 112. Assuming that the contact strips 18 and 20 of contacts 110 and 112 are of differing widths in the manner of the contact 10 of FIG. 1, as the pins enter the illustrated contacts of FIG. 10 a lower insertion force is exerted as the male pins 122 engage the upper contact jaws 18 prior to engaging the lower contact jaws 20. It is also apparent that the points of contact effect a double wiping action as the pins pass the first set of jaws 18 and engage the second set of jaws. The wiping action is desirably greater in FIG. 10 than when a male pin only extends part way into the housing opening for engaging one set of contact jaws only.

Figure 12:
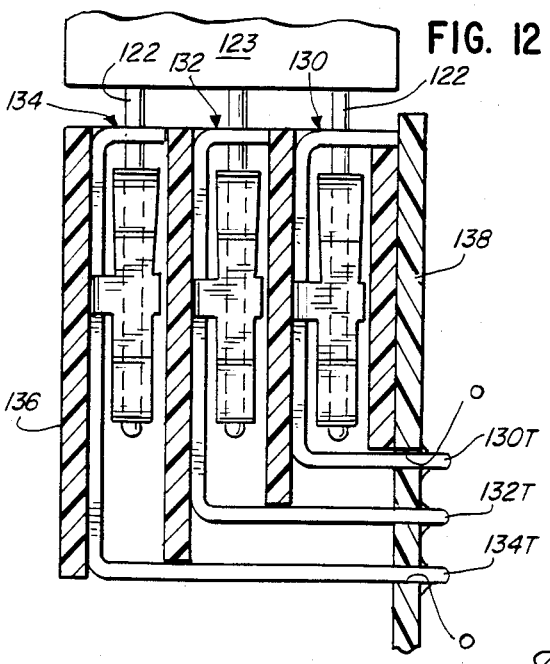
FIG. 12 is a view similar to FIG. 10 illustrating a further modified multi-contact connector-housing assembly made in accordance with this invention.

FIG. 12 illustrates further contact embodiments 130, 132 and 134 in which tail portions 130T and 132T and 134T of increasing length exit from the bottom of insulator 136 in adjacent relationship and engage plated through openings 0 of a printed circuit board 138 illustrated. Pins 122 of plug 123 engage the contact jaws of the contacts 130, 132 and 134 for purposes of effecting a desirable electrical connection similar to that illustrated in the assembly of FIG. 10. The spaced jaw sets of these contacts may also have identical pin-release characteristics.

Figure 13:
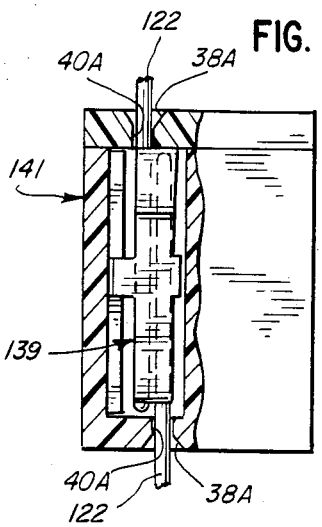
FIG. 13 is a broken-away view partly in elevation illustrating male contacts which are allowed to extend beyond each other in parallel engagement while engaging female jaw portions of a contact made pursuant to this invention.

FIG. 13 illustrates a contact 139 in insulator 141 in which insulator restricted entry guidance openings 40A are out of axial alignment so as to guide opposed illustrated male pins 122 along spaced parallel axes. As a result, the male pins 122 pass each other in the manner illustrated. The pin guidance means may be either the restricted entry openings such as those of FIG. 4 molded integrally with the insulator housing, or may comprise the restricted entry ends such as ends 62 of FIG. 2 integrally formed with the contact structure itself or a combination of both such as is illustrated in FIG. 5. The length of the pins passing each other may be such as to engage both sets of contact jaws resulting in a greater pin wiping action in the course of such engagement. The spaced jaw sets of contact 139 may be of equal or unequal release characteristics.

Figure 14:
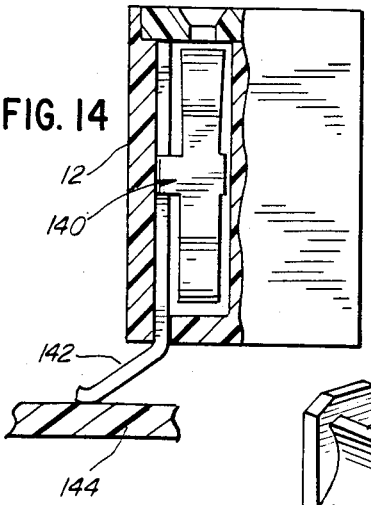
FIGS. 14 and 15 are side elevational views partly in section illustrating contacts made in accordance with this invention for being surface mounted on one and two PC boards respectively.
Figure 15:
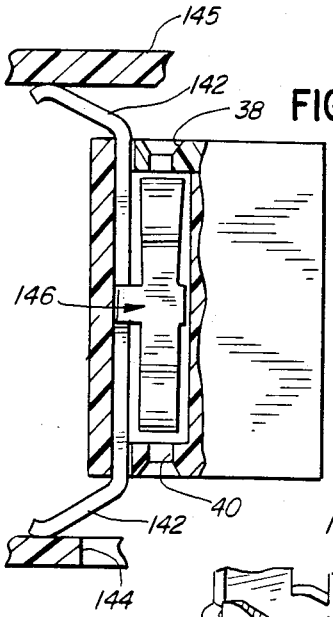

The provided contacts of this invention may also allow desired surface mounting on a PC board if desired in the manner illustrated in FIGS. 14 and 15.

In FIG. 14, contact 140 has a tail portion 142 integrally formed with spine 12, and soldered as by means of vapor phase soldering or the like, to a printed circuit disposed on the surface of printed circuit board 144. Pressure alone may also be employed for effecting a tail-board construction. It will be noted from FIG. 14 that contact 140 is provided with one tail only. Contact 146 of FIG. 15 is provided with both top and bottom tails 142 for purposes of engaging printed circuitry not only on lower printed circuit printed board 144 but also on upper printed circuit board 145. Tails 42 may extend from the spines of any of the illustrated contacts for purposes of providing the advantages of surface mounting.

Figure 16:
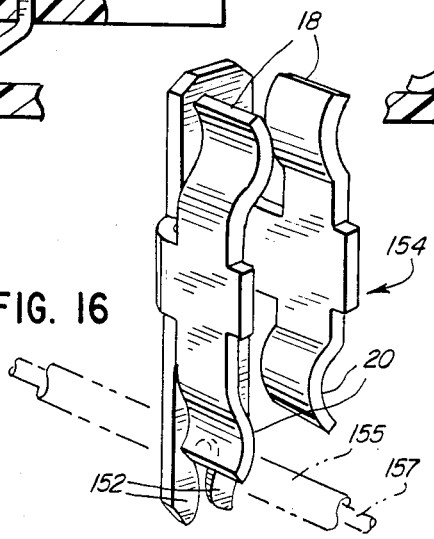
FIG. 16 is a perspective view of a contact made in accordance with this invention adapted to be attached to a wire by means of insulation displacement.

A further feature which may readily be incorporated with contacts made in accordance with this invention comprises a bussing feature whereby a common buss or terminal strip similar to either of the carrier strips 54 of FIG. 3 may be integrally formed with a plurality of contacts. Such common buss may be received in an appropriate slot in an insulator housing. As a result, all of the contacts will be in a common circuit. As an alternative to the use of an integrally formed buss analogous to carrier strip 54, a common buss such as insulation-covered conductor 150 illustrated in phantom line in FIG. 16 may be inserted between jaws such as insulation-piercing jaws 152 of contact 154 of FIG. 16 adapted to pierce insulation 155 covering conductive core 157 for purposes of effecting the desired electrical intercommunication between a plurality of aligned contacts 154. Insulated wire 150 may also come from an external source and connect power or signal to any given contacts. Jaws 152 may be disposed exteriorly of an insulator or within an insulator opening.

Figure 17:
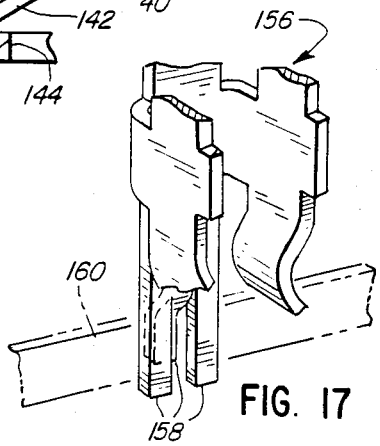
FIG. 17 is a view similar to FIG. 16 fragmentarily illustrating a contact made in accordance with this invention adapted to engage a common buss as well as opposed male contacts.

FIG. 17 illustrates contact 156 having spine clamping portions 158 for gripping a buss rod or strip 160 in electrical engagement. Whereas contact 154 of FIG. 16 because of the buss location may only allow male pins to enter at jaws 18, contact 156 allows both buss engagement and opposed pin engagement simultaneously. Jaws 150 of FIG. 16 may be arranged at right angles to the position illustrated in the manner of clarifying portions 158 of FIG. 17 to allow opposed pin entry.

It is thus seen from the foregoing description that the provided contacts of this invention enable a variety of structural features to be readily incorporated into basic contact designs with the resultant desired functional abilities. The basic contact design provides opposed male contact-engaging jaws which are adaptable to engage electrical male contacts of varied sectional configuration. It is immaterial if the pins or male contacts engaged are of rectilinear, circular or other peripheral configuration, the only limiting factor is the ability of the contact female jaws to effect an electrical engagement with the male contact portion.

It is also believed apparent that the variable insertion and release forces effected by the opposed sets of contact jaws integrally formed with a contact spine may be effected by means other than varied width of the jaw sets. Thus it is possible to employ contact jaws of different thicknesses, the thinner material providing a lesser contact-engaging force. Also, the opposed jaw sets may be formed of different conductive materials for purposes of effecting different contact-engaging forces enabling one contact jaw set to release male pins or the like more easily upon. Pulling opposed male pins of PC boards or male plugs from the female contacts of an intermediate connector. The specific configurations of the contact jaws at the opposed ends may provide jaws adapted to release male pins when different withdrawal forces are applied thereto.

Figure 18:
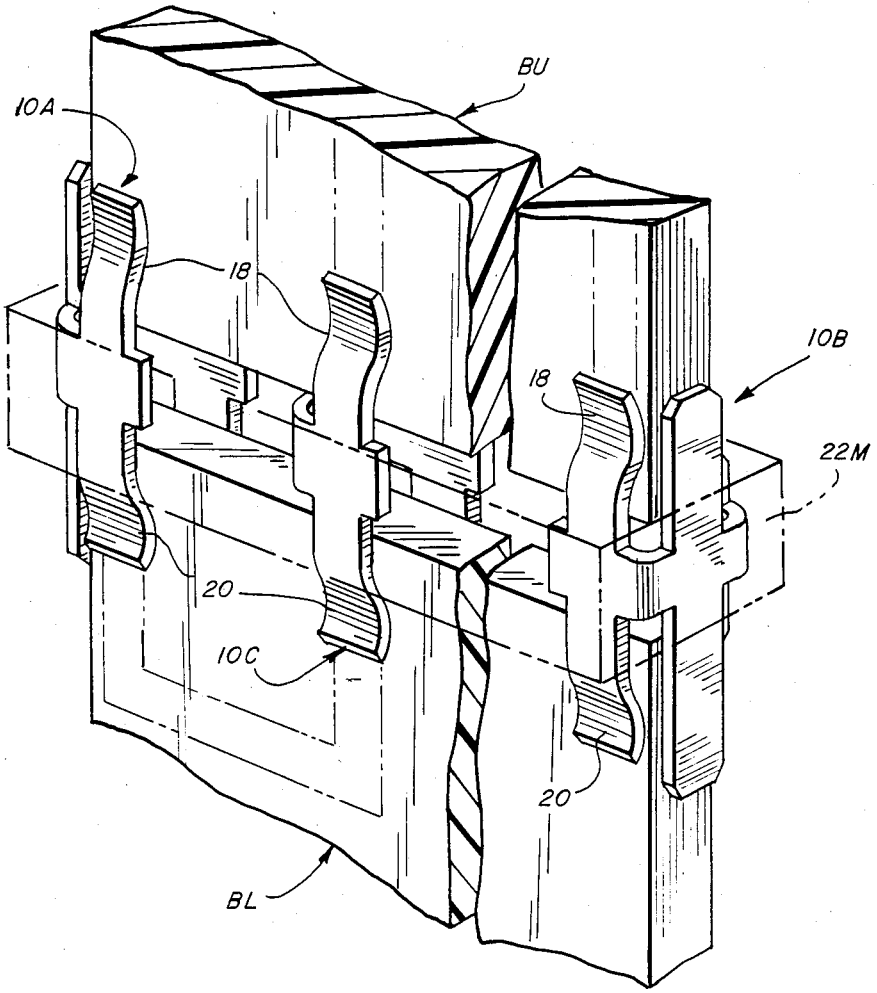
FIG. 18 is a fragmentary perspective view illustrating contacts made in accordance with this invention engaging opposed edges of PC boards.

The opposed jaws of the provided contacts should have good resiliency so as to enable repeated connect-disconnect steps to take place. Also, the contacts above described need not be fully encased in an insulator, but may have one or both sets of jaws exposed. Two spaced, exposed contact jaws may serve as edge connectors for engaging conductive edge portions of a PC board. A plurality of aligned contacts may engage portions of the same PC board edge. If more than two contacts are employed, the spines of contacts intermediate the end contacts may be relieved at their opposed ends to permit board engagement with the jaws. Thus FIG. 18 illustrates opposed connectors 10A and 10B having connector 10C disposed therebetween, with a shortened spine as illustrated. The contacts engage opposed edge portions of PC boards BU and BL. The three connectors have central portions thereof embedded in a housing 22M illustrated in phantom lines. Certain of the opposed contact portions 18–20 of the contacts may engage electrically conductive circuitry disposed on the engaged board portions. The contacts provide for sequential board release in the manner above described.

The foregoing has made apparent the ability to form the contacts of this invention at a relatively low cost whereafter they may be assembled in a desired connector housing. The male contact engaging portions of the female contacts above discussed, may be appropriately plated with metals such as copper, nickel and gold or palladium to enhance the electrical engagement with the male contacts.

As the foregoing has made apparent a number of modifications which may be effected in the structure disclosed, it is intended that the invention be limited only by the scope of the appended claims.

What is claimed is:

1. An electrical contact for detachably receiving male pins at each end, comprising a spine having opposed projecting arms integrally formed with said spine; opposed flat-faced contact strips connected to said spine by means of said arms and extending in opposite directions from each of said arms to form two opposed ends; said strips being inwardly bent to define opposed, resilient jaws at said opposed ends for reception of a mating, male, pin-like contact; resilient jaws defining each of the contact ends and being adapted to resiliently move apart upon reception of a mating, male, pin-like contact therebetween; the resistance to movement of said opposed jaws being different whereby the withdrawal forces imparted to a mating male contact upon withdrawing such mating male contact from said opposed ends are of different magnitude; said contact spine arms and contact strips being integrally formed from a material of formation of substantially uniform thickness; at least one end of said spine being integrally formed with a tab having an opening therein which is aligned over the opposed contact strips; said opening restricting the size of the male contact which may traverse said opening and enter between said strips.

2. The contact of claim 1 in which the spine is integrally formed with at least one anchoring means for anchoring said contacts in place between walls of an opening disposed in an insulator housing.

3. The contact of claim 1 in which said spine is integrally formed with a tab having formed thereon at least one lug adapted to engage a ground plane.

4. The contact of claim 1 in which said tab has at least one projecting lug for engaging a ground plane.

5. The contact of claim 1 in which one end of said contact spine is integrally formed with a contact tail for reception in a receiving opening of a PC Board for effecting an electrical communication therewith.

6. The contact of claim 5 in which said contact tail extends at substantially right angles to the spine longitudinal axis.

7. The contact of claim 5 in which said contact tail extends substantially parallel to the spine longitudinal axis.

8. The contact of claim 5 in which the strip portions defining the contact ends engage a male pin at four points of engagement and said contact tail engages circuitry of a PC board.

9. The contact of claim 1 in which said spine has at least one projecting portion configured for electrical connection to circuitry on a PC board by surface mount technology.

10. An electrical contact for detachably receiving male pins at each end, comprising a spine having opposed projecting arms integrally formed with said spine; opposed flat-faced contact strips connected to said spine by means of said arms and extending in opposite directions from each of said arms to form two opposed ends; said strips being inwardly bent to define opposed resilient jaws at said opposed ends for reception of a mating pin-like male contact at said opposed ends; said jaws being of such formation so as to effect opposed tangential, engagements with such pin-like contact received therebetween; the width of the jaws at one contact end being greater than the width of the contact jaws at the other contact end thereby the resistance to movement of said opposed jaws is different and the withdrawal forces imparted to a mating male contact upon withdrawing said mating male contact from said opposed ends are of different magnitude.

11. The contact of claim 10 in combination with an insulator housing having at least one contact-receiving opening formed therein, said opening having one housing entryway for passage of a pin contact and being of such size as to prevent removal of said contact therethrough; said entryway also being of such size and configuration as to allow guided passage therethrough of a male contact of predeterminate size for entering between the contact strips.

12. The contact of claim 10 in combination with male pin-aligning means disposed adjacent the opposed ends of said contact whereby male pin contacts may enter between the opposed contact strip ends in parallel, non-coaxial alignment, thereby enabling each of such male contacts to engage both ends of said contact strips.

13. The contact of claim 1 or 10 in combination with a PC board having an electrically conductive edge portion thereof inserted between contact strip portions defining one contact end.

* * * * *